US007597433B2

(12) United States Patent
Tanahashi et al.

(10) Patent No.: US 7,597,433 B2
(45) Date of Patent: Oct. 6, 2009

(54) INK CARTRIDGE, INKJET PRINTER AND COMBINATION THEREOF

(75) Inventors: Naokazu Tanahashi, Nagoya (JP); Shingo Ito, Kasugai (JP); Wataru Sugiyama, Aichi-ken (JP); Noritsugu Ito, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 502 days.

(21) Appl. No.: 11/616,321

(22) Filed: Dec. 27, 2006

(65) Prior Publication Data

US 2007/0176987 A1 Aug. 2, 2007

(30) Foreign Application Priority Data

Dec. 28, 2005 (JP) ..... 2005-377009

(51) Int. Cl.
*B41J 2/175* (2006.01)

(52) U.S. Cl. ..... 347/86

(58) Field of Classification Search ..... 347/86, 347/87

See application file for complete search history.

(56) References Cited

U.S. PATENT DOCUMENTS

| | | | | |
|---|---|---|---|---|
| 6,130,695 | A | 10/2000 | Childers et al. | |
| 7,011,397 | B2 * | 3/2006 | Miyazawa et al. | 347/86 |
| 7,237,882 | B2 * | 7/2007 | Miyazawa et al. | 347/86 |
| 2005/0146577 | A1 | 7/2005 | Sasaki et al. | |

FOREIGN PATENT DOCUMENTS

| | | | |
|---|---|---|---|
| JP | 5301350 | A | 11/1993 |
| JP | 796302 | B2 | 10/1995 |
| JP | 200334038 | A | 2/2003 |
| JP | 2004216607 | A | 8/2004 |
| JP | 2004216608 | A | 8/2004 |

OTHER PUBLICATIONS

European Patent Office, European Search Report for EP Appl'n. No. 06026598 (counterpart to above-captioned patent appl'n) mailed Mar. 23, 2007.

* cited by examiner

*Primary Examiner*—An H Do
(74) *Attorney, Agent, or Firm*—Baker Botts, LLP

(57) ABSTRACT

An ink cartridge includes a cartridge body including an ink storage chamber and a wall having an ink introduction hole formed therethrough. The ink introduction hole is configured to receive an ink supply tube of an inkjet printer when the ink cartridge is mounted to the inkjet printer, and the ink supply tube is configured to communicate with an ink supply channel of the inkjet printer via a communication path. The ink cartridge also includes a first valve member configured to selectively open and close the ink introduction hole, and a first urging member configured to apply a first force to the first valve member to urge the first valve member to close the ink introduction hole. The first valve member includes a valve body configured to receive a second force from the ink supply tube when the ink cartridge is mounted to the inkjet printer. The second force urges the first valve member to open the ink introduction hole, and the second force is greater than the first force. The first valve member also includes a projecting portion which projects from the valve body in a predetermined direction toward the exterior of the ink storage chamber via the ink introduction hole. The projecting portion is configured to enter the ink supply tube and to apply a third force to a second valve element of the inkjet printer to urge the second valve element to open the communication path between the ink supply tube and the ink supply chamber when the ink cartridge is mounted to the inkjet printer. Moreover, a second urging member of the inkjet printer is configured to apply a fourth force to the second valve element to urge the second valve element to close the communication path between the ink supply tube and the ink supply chamber, and the third force is greater than the fourth force.

15 Claims, 23 Drawing Sheets

INK CARTRIDGE, INKJET PRINTER AND COMBINATION THEREOF

The present application claims priority from Japanese Patent Application No. JP-2005-377009, which was filed on Dec. 28, 2005, the disclosure of which is incorporated by reference in its entirety.

BACKGROUND OF THE INVENTION

1. Field of the Invention

The present invention relates generally to ink cartridges, inkjet printers, and combinations thereof.

2. Description of Related Art

A known inkjet printer comprises an ink supply device for supplying ink to a print head, an ink cartridge mounting portion, and an ink cartridge which is configured to be mounted to and demounted from the ink cartridge mounting portion. The ink cartridge mounting portion comprises an ink supply tube which extends in a direction along which the ink cartridge is mounted to the ink cartridge mounting portion. When the ink cartridge is mounted to the ink cartridge mounting portion, the ink supply tube is inserted into the ink cartridge, and ink disposed within the ink cartridge is supplied to the print head via the ink supply tube. When the ink cartridge is demounted from the cartridge mounting portion, ink may leak from the ink cartridge or the ink supply tube, or both, and/or air may enter the ink cartridge or the ink supply tube, or both.

To address the above-described problems, another known printer comprises an ink supply device and an ink supply tube. The ink supply tube comprises a valve which is configured to selectively open and close an opening formed at the distal end of ink supply tube, and a valve stopper which is configured to restrict the amount that the valve is deformed when the valve is deformed to open the opening. The ink cartridge comprises a piston which is configured to selectively open and close an ink supply port for supplying ink from an interior of the ink cartridge to an exterior of the ink cartridge. The piston is urged by a spring to close the ink supply port.

When the ink cartridge is not mounted to the ink cartridge mounting portion, the opening of the ink supply tube is closed by the valve, and the ink supply port of the ink cartridge is closed by the piston, such that ink does not leak from the ink cartridge or the ink supply tube, or both, and air does not enter the ink cartridge or the ink supply tube, or both. However, when the ink cartridge is mounted to the ink cartridge mounting portion, the distal end of the ink supply tube is inserted into the ink cartridge, and the valve is pressed by the distal end of the piston of the ink cartridge, such that the valve deforms inwardly to open the opening. When the valve deforms inwardly, the valve contacts the valve stopper, the valve stopper applies a force to the piston, and the piston retracts against the urging force of the spring, such that the piston opens the ink supply port of the ink cartridge. Ink in the ink cartridge then is supplied to the print head via the ink supply tube.

Nevertheless, this known ink cartridge uses a valve stopper to restrict the amount that the valve is deformed when the valve is deformed to open the opening, which increases the number of components of the printer, which increases the cost of manufacturing the printer.

SUMMARY OF THE INVENTION

Therefore, a need has arisen for ink cartridges, inkjet printers, and combinations thereof, which overcome these and other shortcomings of the related art. A technical advantage of the present invention is that an ink cartridge, an inkjet printer, or a combination thereof, may be configured to prevent ink from leaking from the ink cartridge or the ink supply tube, or both, and to prevent air from entering the ink cartridge or the ink supply tube, or both, without increasing the number of components.

According to an embodiment of the present invention, an ink cartridge comprises a cartridge body comprising an ink storage chamber configured to store ink therein, and a particular wall having an ink introduction hole formed therethrough. The ink introduction hole is configured to receive an ink supply tube of an inkjet printer when the ink cartridge is mounted to the inkjet printer, and the ink supply tube is configured to communicate with an ink supply channel of the inkjet printer via a communication path. The ink cartridge also comprises a first valve member configured to selectively open and close the ink introduction hole, and a first urging member configured to apply a first force to the first valve member to urge the first valve member to close the ink introduction hole. The first valve member comprises a valve body configured to receive a second force from the ink supply tube when the ink cartridge is mounted to the inkjet printer, the second force urges the first valve member to open the ink introduction hole, and the second force is greater than the first force. The first valve member also comprises a projecting portion which projects from the valve body in a predetermined direction toward the exterior of the ink storage chamber via the ink introduction hole. Moreover, the projecting portion is configured to enter the ink supply tube and to apply a third force to a second valve element of the inkjet printer to urge the second valve element to open the communication path between the ink supply tube and the ink supply chamber when the ink cartridge is mounted to the inkjet printer. In addition, a second urging member of the inkjet printer is configured to apply a fourth force to the second valve element to urge the second valve element to close the communication path between the ink supply tube and the ink supply chamber, and the third force is greater than the fourth force.

According to another embodiment of the present invention, an inkjet printer comprises an ink supply tube configured to enter an ink introduction hole of an ink cartridge and to apply a first force to a valve body of a first valve member of the ink cartridge when the ink cartridge is mounted to the inkjet printer. Moreover, a first urging member of the ink cartridge is configured to apply a second force to the first valve member to urge the first valve member to close the ink introduction hole, and the first force is greater than the second force. The inkjet printer also comprises an ink supply channel configured to communicate with the ink supply tube via a communication path, and a second valve member configured to selectively open and close the communication path between the ink supply tube and the ink supply channel. Moreover, the inkjet printer comprises a second urging member configured to apply a third force to the second valve member to urge the second valve member to close the communication path between the ink supply tube and the ink supply channel. A projection portion of the valve body of the first valve member is configured to apply a fourth force to the second valve member to urge the second valve member to open the communication path between the ink supply tube and the ink supply channel when the ink cartridge is mounted to the inkjet printer, and the fourth force is greater than the third force.

According to yet another embodiment of the present invention, an inkjet printing apparatus comprises an inkjet printer and an ink cartridge. The inkjet printer comprises an ink supply tube, an ink supply channel configured to communicate with the ink supply tube via a communication path, a first valve member configured to selectively open and close the communication path between the ink supply tube and the ink supply channel, and a first urging member configured to apply a first force to the first valve member to urge the first valve member to close the communication path between the ink supply tube and the ink supply channel. The ink cartridge comprises a cartridge body comprising an ink storage chamber configured to store ink therein, and a particular wall, wherein the particular wall has an ink introduction hole formed therethrough. The ink cartridge also comprises a second valve member configured to selectively open and close the ink introduction hole, and a second urging member configured to apply a second force to the second valve member to urge the second valve member to close the ink introduction hole. The second valve member comprises a valve body, and a projecting portion which projects from the valve body in a predetermined direction toward the exterior of the ink storage chamber via the ink introduction hole. Moreover, the ink cartridge is configured to be mounted to the inkjet printer, and the ink introduction hole is configured to receive the ink supply tube when the ink cartridge is mounted to the inkjet printer. The projecting portion is configured to enter the ink supply tube and to apply a third force to the first valve member to urge the first valve member to open the communication path between the ink supply tube and the ink supply channel when the ink cartridge is mounted to the inkjet printer, and the ink supply tube is configured to apply a fourth force to the valve body of the second valve member to urge the second valve member to open the ink introduction hole when the ink cartridge is mounted to the inkjet printer. Moreover, the third force is greater than the first force, and the fourth force is greater than the second force.

Other objects, features, and advantage will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF EMBODIMENTS OF THE INVENTION

Embodiments of the present invention, and their features and advantages, may be understood by referring to FIGS. 1-23, like numerals being used for like corresponding parts in the various drawings.

Figure 1:
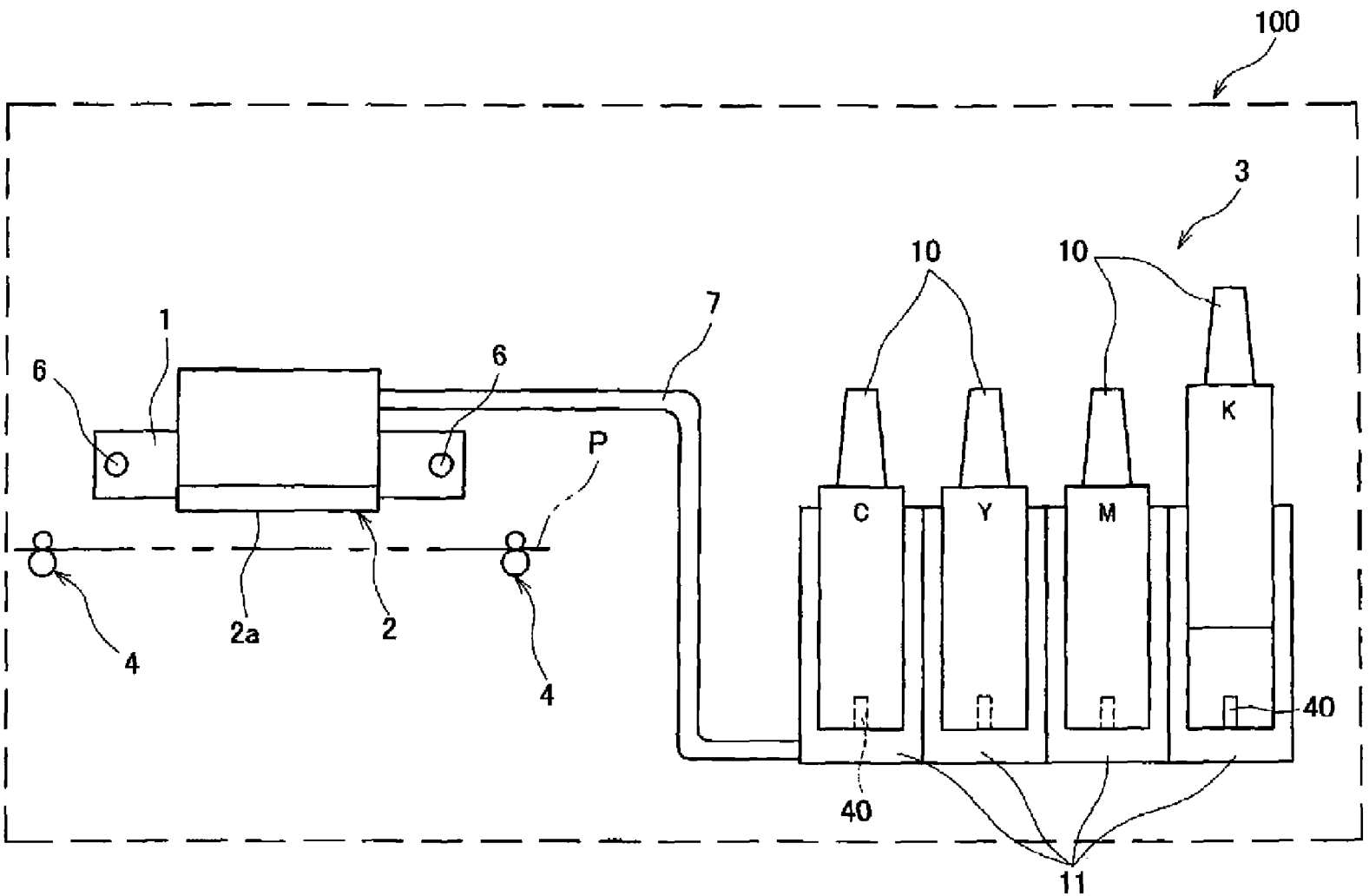
FIG. 1 is a schematic diagram of an inkjet printer, according to an embodiment of the present invention.

Referring to FIG. 1, an inkjet printer 100, e.g., a color inkjet printer, may comprise a carriage 1 which may be configured to linearly reciprocate in a predetermined direction along a guide 6. Inkjet printer 100 may also comprise an inkjet head 2 mounted to carriage 1. Inkjet head 2 may comprise a plurality of nozzles configured to discharge ink onto a printing paper 2. For example, inkjet head 2 may comprise four types of nozzles, and the nozzles may be configured to dispense cyan (C) colored ink, yellow (Y) colored ink, magenta (M) colored ink, and black (K) colored ink, respectively, onto printing paper P. Moreover, inkjet printer 100 may comprise an ink supply device 3 configured to supply ink to inkjet head 2, and a transporting device 4 configured to feed printing paper P in a direction which is orthogonal to the direction of movement of inkjet head 2, and is parallel to an ink discharge surface 2*a* of inkjet head 2. Inkjet head 2 and holders 11 of ink supply device 3 may be connected to each other via supply tubes 7. Inkjet printer 100 may eject ink toward printing paper P while inkjet head 2 reciprocates in the predetermined direction, and printing paper P may move in the left-and-right direction in FIG. 1, such that a desired image may be formed on printing paper P.

Ink supply device 3 may comprise at least one ink cartridge 10 and at least one holder 11, and each ink cartridge 10 may be configured to be mounted to and demounted from a corresponding holder 11. For example, ink supply device may comprise four ink cartridges 10, and ink cartridges 10 may contain cyan (C) colored ink, yellow (Y) colored ink, magenta (M) colored ink, and black (K) colored ink, respectively. Moreover, the number of holders 11 may correspond to the number of ink cartridges 10.

Figure 2:
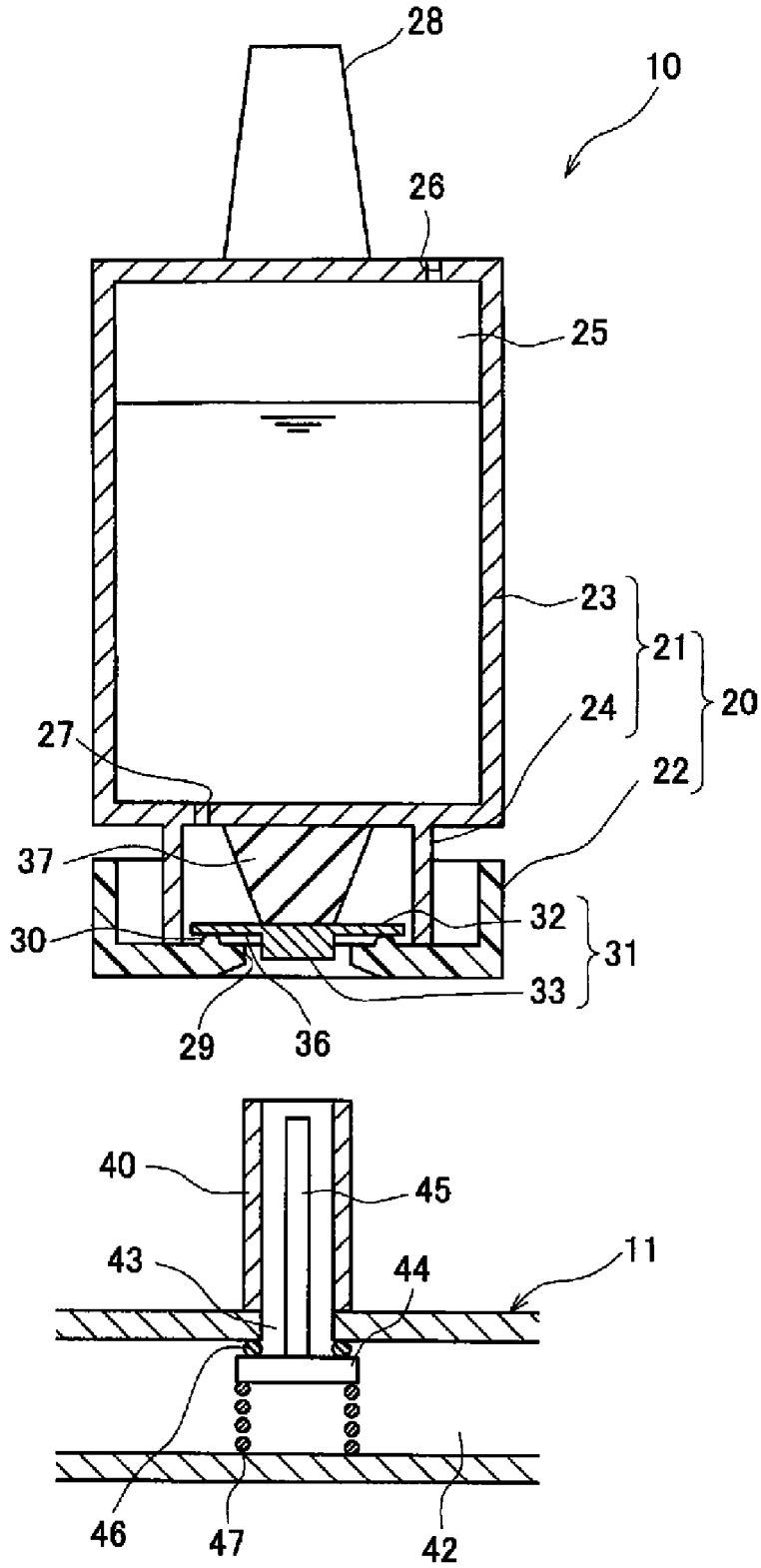
FIG. 2 is a cross-sectional view of an ink cartridge and a holder, according to an embodiment of the present invention.

Referring to FIG. 2, ink cartridge 10 may comprises a cartridge body 20. Cartridge body 20 may comprise a body member 21 configured to store ink, and a cap 22. Cap 22 may be positioned at the lower end of body member 21, and body member 21 may comprise an ink storage section 23 and a cylindrical portion 24. Ink storage section 23 may have a substantially vertically elongated parallelepiped shape, and cylindrical portion 24 may extend downward from the lower end of ink storage section 23. Ink storage section 23 and cylindrical portion 24 may be formed integrally, e.g., may be integrally molded. Ink storage section 23 may comprise an ink storage chamber 25 configured to store ink, and an atmospheric air communication hole 26 may be formed through an upper wall of ink storage section 23. Atmospheric air communication hole 26 may be configured to communicate ink storage chamber 25 with atmospheric air. An ink discharge hole 27 may be formed through a lower wall of ink storage section 23, and ink storage chamber 25 and a space within cylindrical portion 24 may be in communication with each other via ink discharge hole 27. Therefore, atmospheric air may be introduced through atmospheric air communication hole 26 into ink storage chamber 25, and ink in ink storage chamber 25 may be discharged through ink discharge hole 27 into the space within cylindrical portion 24. Moreover, a tab 28 may be integrally formed at an upper end portion of body member 21.

Figure 5:
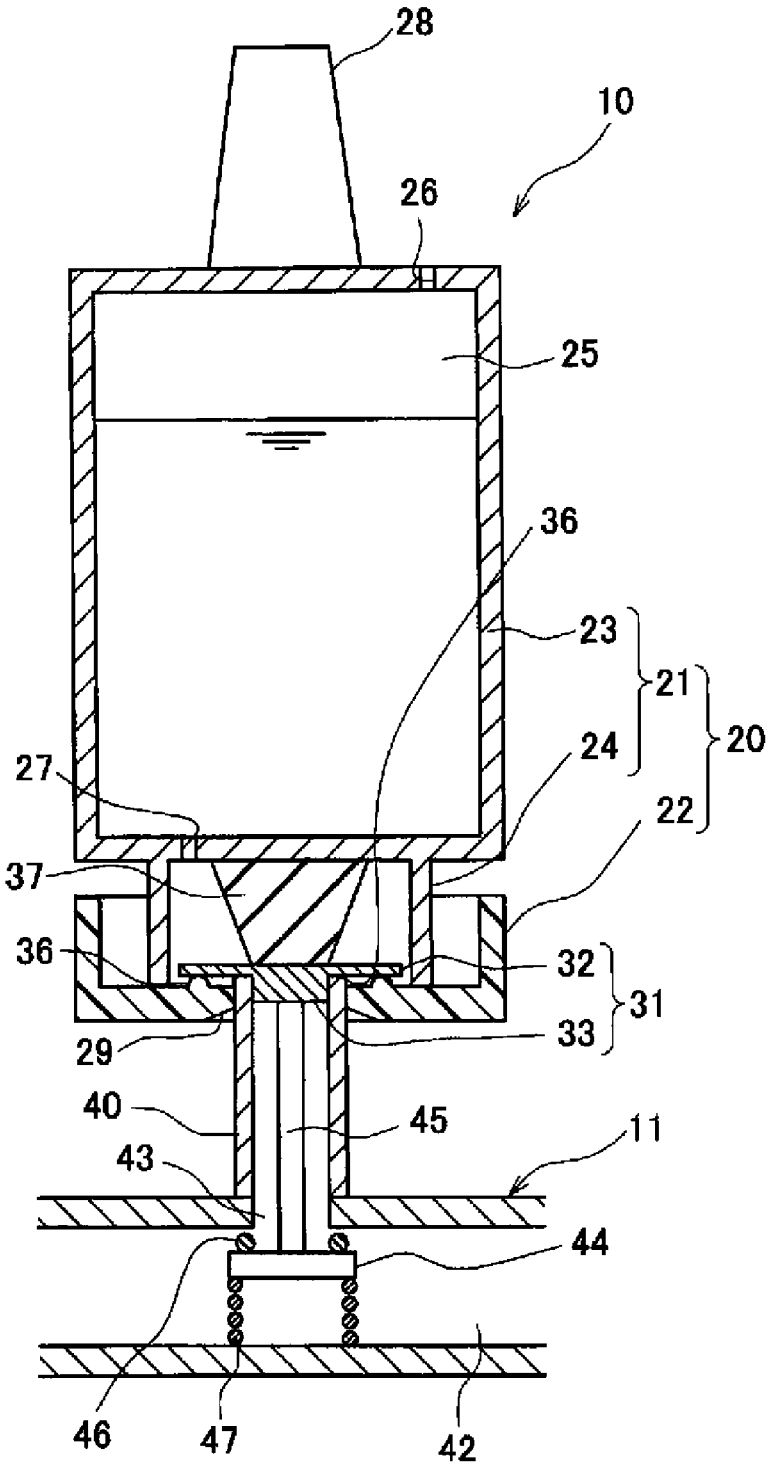
FIG. 5 is a cross-sectional view of the ink cartridge and the holder of FIG. 2, in which the ink cartridge is partially mounted to the holder, according to an embodiment of the present invention.
Figure 6:
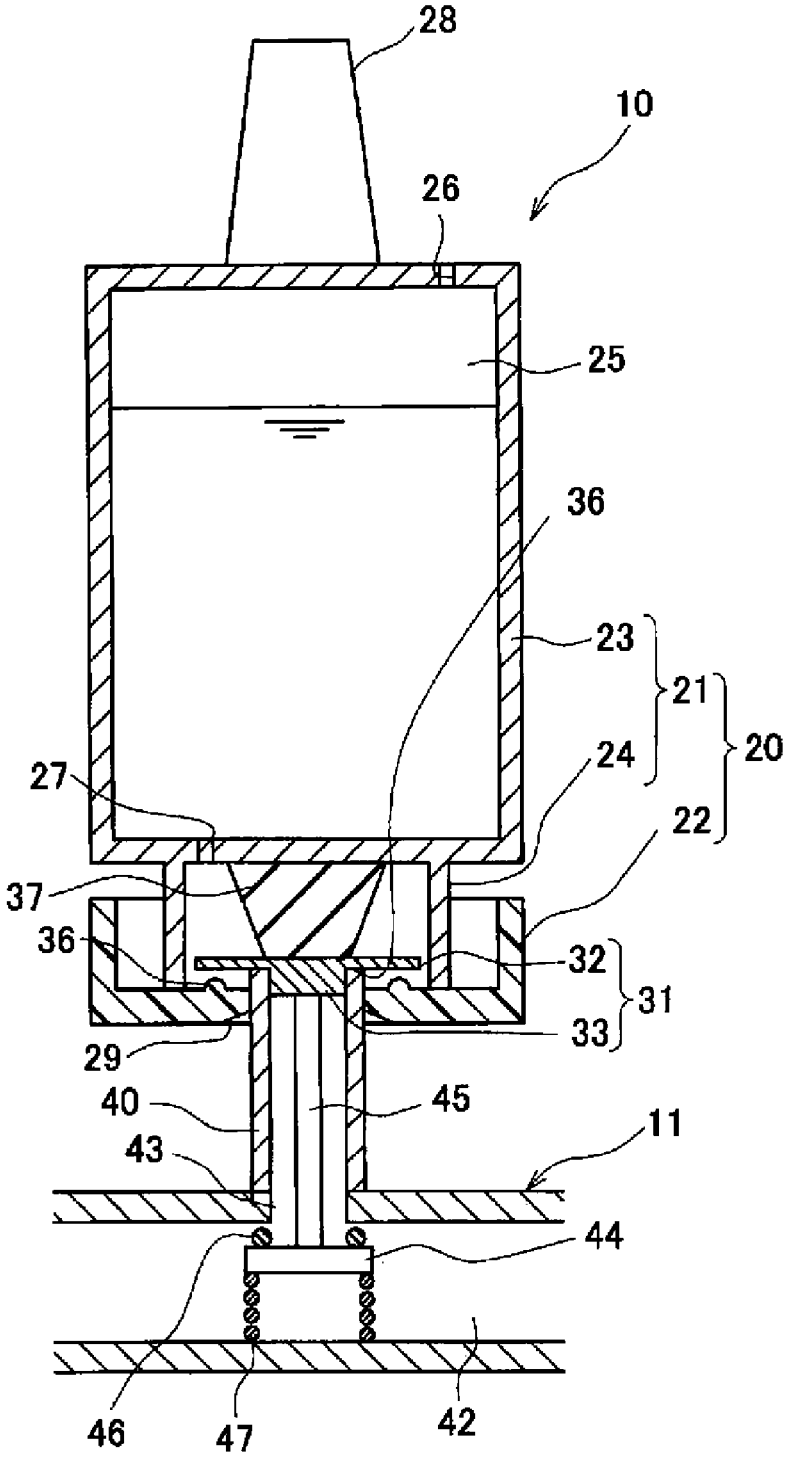
FIG. 6 is a cross-sectional view of the ink cartridge and the holder of FIG. 2, in which the ink cartridge is completely mounted to the holder, according to an embodiment of the present invention.

Cap 22 may be attached to the lower end portion of cylindrical portion 24, and cap 22 may close the space within cylindrical portion 24 from below. An ink introduction hole 29 may be formed through the center of the bottom portion of cap 22. Referring to FIGS. 5 and 6, when ink cartridge 10 is mounted to holder 11 and an ink supply tube 40 provided on holder 11 is inserted into ink introduction hole 29, ink may flow out from the space within cylindrical portion 24 to ink supply tube 40. In order to facilitate entry of the distal end of ink supply tube 40 into cylindrical portion 24, ink introduction hole 29 may have a tapered shape, such that the diameter of introduction hole 29 increases as it approaches ink supply tube 40.

Figure 3:
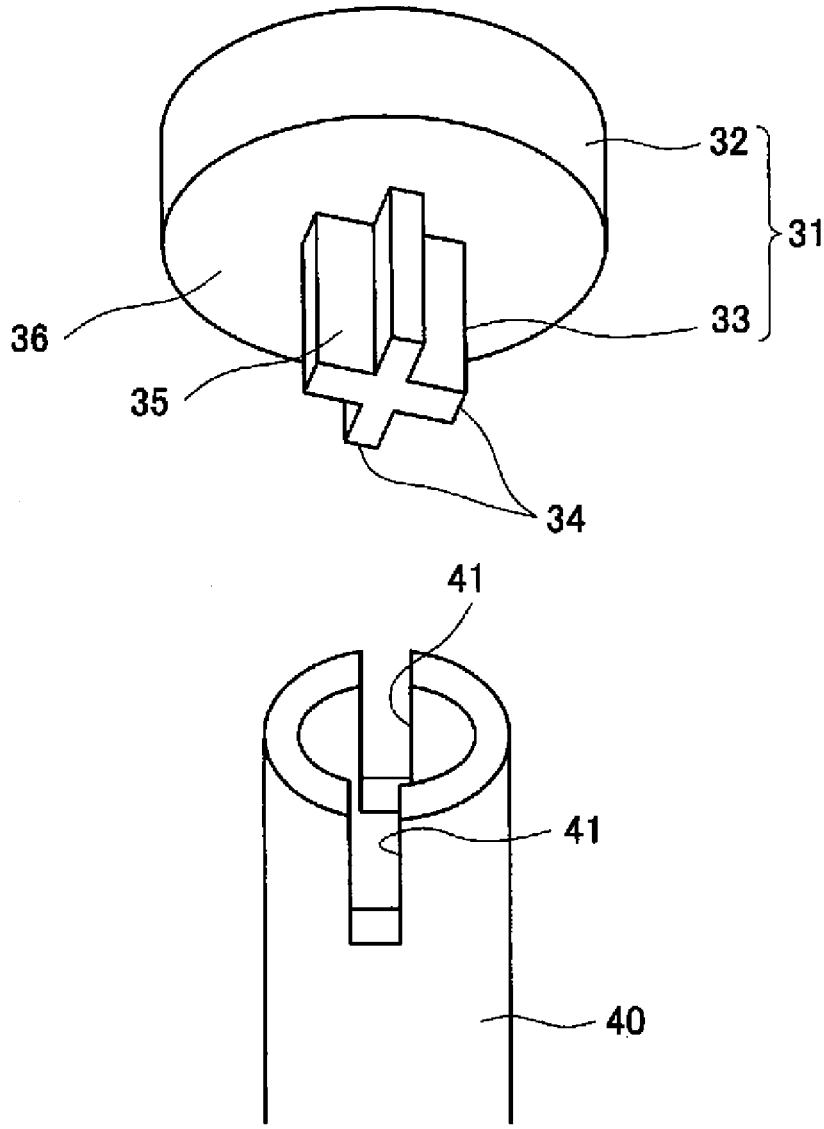
FIG. 3 is a perspective view of a valve member of the ink cartridge of FIG. 2, and a distal end of an ink supply tube, according to an embodiment of the present invention.

Referring to FIG. 2, cap 22 may comprise an annular valve seat 30 on the bottom surface of cap 22. Annular valve seat 30 may project upward and surround introduction hole 29. Cylindrical portion 24 may comprise a valve member 31 configured to move in the vertical direction. Referring to FIGS. 2 and 3, valve member 31 may comprise a disc-shaped valve body 32 and a projecting portion 33. Projecting portion 33 may project from the center of the lower surface of valve body 32 downward in a direction orthogonal to the lower surface of valve body 32. Valve body 32 and projecting portion 33 may be formed integrally, e.g., may be integrally molded. Valve member 31 may open ink introduction hole 29 when there is a gap between valve member 31 and valve seat 30, and may close ink introduction hole 29 when valve member 31 is in tight contact with valve seat 30.

A resilient member 37 may be disposed on the upper side of valve member 31, and valve member 31 may be urged toward valve seat 30 by resilient member 37. Therefore, when ink cartridge 10 is not mounted, valve member 31 may be pressed against valve seat 30 by an urging force of resilient member 37, such that ink introduction hole 29 is closed.

Cap 22 may comprise a flexible material, e.g., rubber or elastomer, such that the contact between valve member 31 and valve seat 30 may be enhanced to reliably close ink introduction hole 29.

Figure 4:
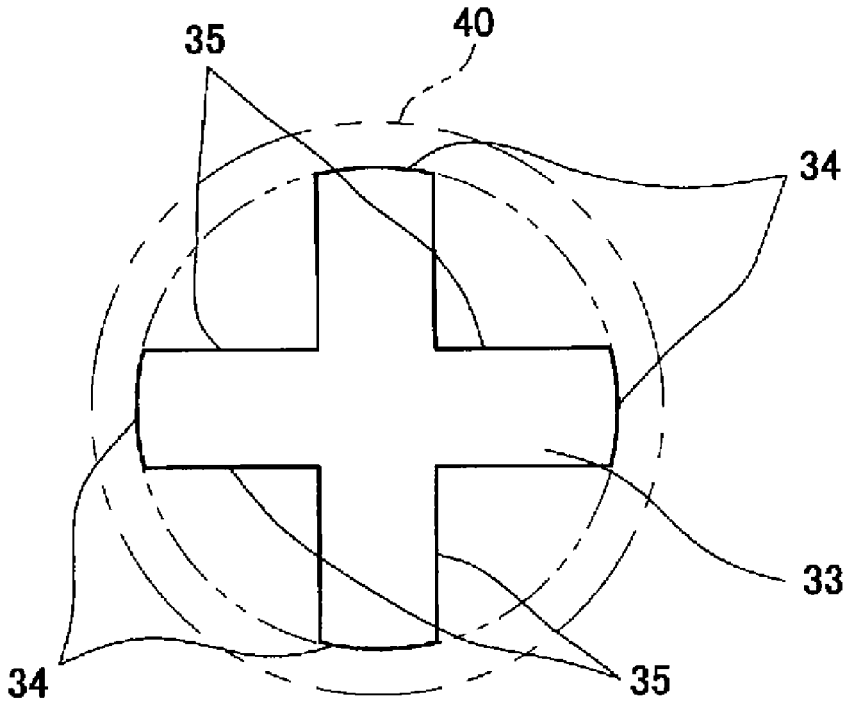
FIG. 4 is a diagram of a projecting portion of the valve member of FIG. 3 entering the interior of the ink supply tube of FIG. 3, according to an embodiment of the present invention.

Referring to FIGS. 5 and 6, when ink cartridge 10 is mounted to holder 11 and ink supply tube 40 is inserted into ink introduction hole 29, projecting portion 33 may enter the interior of ink supply tube 40. Referring to FIGS. 3 and 4, the shape of the projecting portion 33 when viewed from below may be a cross-shape. Projecting portion 33 may comprise a distal end and a peripheral surface connecting the lower surface of valve body 32 and the distal end of projecting portion 33. The peripheral surface of projecting portion 33 may comprise a plurality of contacting portions 34, e.g., four contacting portions 34, arranged at regular intervals in a circumferential direction of projecting portion 33. When projecting portion 33 enters the interior of ink supply tube 40, contacting portions 34 may contact the inner surface of ink supply tube 40. Moreover, portions of the peripheral surface of projecting portion 33 arranged respectively between the adjacent ones of contacting portions 34 in the circumferential direction may be non-contacting portions 35 which do not contact the inner surface of ink supply tube 40.

When ink cartridge 10 is mounted to holder 11, the distal end of ink supply tube 40 may contact a pressed portion 36 of the lower surface of valve body 32, and pressed portion 36 may be pressed upward by ink supply tube 40, such that ink introduction hole 29 is opened.

Referring to FIGS. 1 and 2, holder 11 may comprise ink supply tube 40 extending upward from the bottom portion of holder 11. Referring to FIG. 3, a pair of notches 41 may be formed through ink supply tube 40. Notches 41 may extend from the distal end of ink supply tube 40 in the axial direction of ink supply tube 40. An ink supply channel 42 may be formed in the bottom portion of holder 11, and ink supply channel 42 may continue from the lower end of ink supply tube 40 and may be connected to inkjet head 2 via supply tube 7. Referring to FIGS. 5 and 6, when ink cartridge 10 is mounted to holder 11, ink supply tube 40 may be inserted into ink introduction hole 29, such that the distal end of ink supply tube 40 presses pressed portion 36 of valve member 31 upward. When the distal end of ink supply tube 40 is inserted though the ink introduction hole 29 into cylindrical portion 24, projecting portion 33 on valve member 31 may enter ink supply tube 40.

Referring to FIG. 2, a valve member 44 may be positioned in the vicinity of a connecting portion 43 between ink supply tube 40 and ink supply channel 42. Valve member 44 may be configured to move in the vertical direction. A valve rod 45 may extend from the upper surface of valve member 44 upward within ink supply tube 40. The distal end of valve rod 45 may be positioned within ink supply tube 40 irrespective of the position of valve member 44, and valve rod 45 may not project upward from ink supply tube 40 even when valve member 44 is moved in the vertical direction. An O-ring 46 may comprise a flexible material, such as rubber, and may be mounted to the upper surface of valve member 44. Referring to FIG. 2, when valve member 44 contacts the inner wall portion of ink supply channel 42 via O-ring 46, a communication path between ink supply tube 40 and ink supply channel 42 through connecting portion 43 is closed. Referring to FIGS. 5 and 6, when valve member 44 is separated from the inner wall portion of ink supply channel 42 in the vicinity of connecting portion 43, the communication path is open.

A spring 47 may be positioned on the lower side of valve member 44, and valve member 44 is urged upward by spring 47. Therefore, when ink cartridge 10 is not mounted to holder 11, valve member 44 may be pressed against the inner wall portion near connecting portion 43 by an urging force of spring 47, and the communication path between ink supply tube 40 and ink supply channel 42 through connecting portion 43 is closed. When ink cartridge 10 is mounted to holder 11, valve member 31 may enter the interior of ink supply tube 40, valve member 44 may be pressed downward against the urging force of spring 47 by projecting portion 33 of valve member 31, and valve member 44 may separate from the inner wall portion, such that ink supply channel 42 communicates with the interior of ink supply tube 40. The urging force of spring 47 to urge valve member 44 upward before ink cartridge 10 is mounted to holder 11 may be less than an urging force of resilient member 37 to urge valve member 31 downward.

Referring to FIG. 2, when ink cartridge 10 is not mounted to holder 11, valve member 31 may be urged downward by resilient member 37 and may be pressed against valve seat 30 within ink cartridge 10, and ink introduction hole 29 may be closed by valve member 31. On the other hand, in the holder 11, valve member 44 may be urged upward by spring 47, and O-ring 46 may be pressed against the inner wall portion of ink supply channel 42 in the vicinity of connecting portion 43, such that valve member 44 prevents communication between ink supply tube 40 and ink supply channel 42 via connecting portion 43. Therefore, ink may not leak from ink cartridge 10 or ink supply tube 40, and air may not enter ink cartridge 10 or ink supply tube 40.

Referring to FIG. 5, when ink cartridge 10 is pressed into the holder 11, ink supply tube 40 may be inserted into introduction hole 29, and projecting portion 33 of valve member 31 may enter the interior of ink supply tube 40 and may contact the distal end of valve rod 45 positioned within ink supply tube 40. As described above, the urging force of spring 47 in holder 11 to urge valve member 44 upward may be less than the urging force of resilient member 37 in ink cartridge 10 to urge valve member 31 downward. Therefore, when ink cartridge 10 is pressed inwardly of holder 11, valve member 44 may be pressed downward against the urging force of spring 47 by projecting portion 33. Then, O-ring 46 may separate from the inner wall portion in the vicinity of connecting portion 43 between ink supply tube 40 and ink supply channel 42, such that ink supply tube 40 and ink supply channel 42 may communicate with each other via connecting portion 43. When projecting portion 33 enters the interior of ink supply tube 40, contacting portions 34 may contact the inner surface of ink supply tube 40, and the motion of projecting portion 33 entering ink supply tube 40 may be guided by contacting portions 34.

Referring to FIG. 6, when ink cartridge 10 is pressed further downward, the urging force of compressed spring 47 increases, such that valve member 44 does not move further downward, and pressed portion 36 of valve member 31 of ink cartridge 10 is pressed back upward against the urging force of resilient member 37 by the distal end of ink supply tube 40. Then, valve member 31 may separate from valve seat 30 formed on cap 22, such that ink introduction hole 29 is opened.

Referring to FIG. 4, because non-contacting portions 35 do not contact the inner surface of ink supply tube 40, passages through which ink flows may be provided between non-contacting portions 35 and the inner surface of ink supply tube 40. Therefore, ink in cylindrical portion 24 of ink cartridge 10 may flow into ink supply channel 42 via notches 41 formed at the distal end of ink supply tube 40 and via the passages provided between non-contacting portions 35 and the inner surface of ink supply tube 40. The ink may be further supplied to inkjet head 2 via ink supply channel 42.

Because ink introduction hole 29 of ink cartridge 10 and ink supply channel 42 of holder 11 may be respectively opened only when ink cartridge 10 is mounted to holder 11, when ink cartridge 10 is not mounted to holder 11, ink does not leak from ink cartridge 10 or ink supply tube 40 of holder 11, and air does not enter the interior of ink cartridge 10 or ink supply tube 40. Moreover, because pressed portion 36 of valve member 31 is pressed by the distal end of ink supply tube 40 and ink introduction hole 29 is opened, a specific member for pressing valve member 31 to open ink introduction hole 29 is not necessary, which reduces the number of components which reduces manufacturing costs.

In addition, because valve rod 45 of valve member 44 is positioned in the interior of ink supply tube 40, and does not project out from ink supply tube 40, valve member 44 may be prevented from being pressed downward when ink cartridge 10 is not mounted to holder 11. Therefore, the communication between ink supply tube 40 and ink supply channel 42 through connecting portion 43 may be prevented when ink cartridge 10 is not mounted to holder 11. Further, the motion of projecting portion 33 entering ink supply tube 40 may be guided by four contacting portions 34, such that mounting of ink cartridge 10 may be performed reliably. Moreover, because contacting portions 34 may provided at regular intervals in a circumferential direction of projecting portion 33, the motion of projecting portion 33 entering ink supply tube 40 may be guided uniformly at the circumference, such that mounting of ink cartridge 10 may be performed reliably. In addition, because non-contacting portions 35 which do not contact the inner surface of ink supply tube 40 may be also provided on the peripheral surface of the projecting portion 33, the ink passages may be securely provided between the inner surface of ink supply tube 40 and non-contacting portion 35 when projecting portion 33 of valve member 31 enters the interior of ink supply tube 40. Therefore, even when the diameter of ink supply tube 40 is reduced, ink may flow into ink supply tube 40. By reducing the diameter of ink supply tube 40 in this manner, the contact surface area between ink supply tube 40 and ink introduction hole 29 may be reduced. Resistance when ink cartridge 10 is mounted and demounted may be reduced, and mounting and demounting of ink cartridge 10 may be facilitated. When the diameter of ink supply tube 40 is reduced, the amount of leakage of ink or entrance of air at the time of mounting and demounting of ink cartridge 10 may also be reduced. Moreover, because non-contacting portions 35 may be arranged respectively between the adjacent ones of contacting portions 34 provided at regular intervals in a circumferential direction of projecting portion 33, the ink passages between ink supply tube 40 and non-contacting portions 35 may be symmetrical with respect to the axis of ink supply tube 40, such that ink may flow smoothly in ink supply tube 40.

Figure 7:
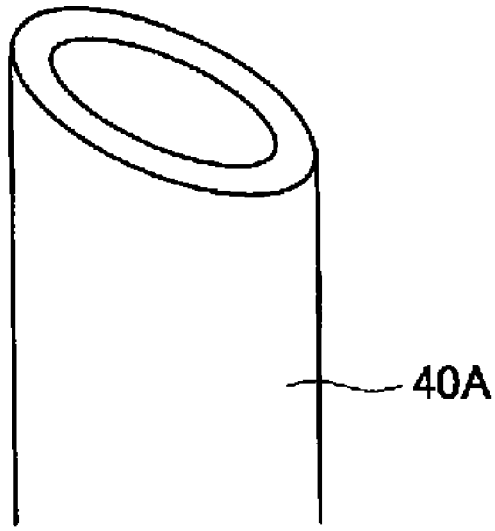
FIG. 7 is a perspective view of a distal end of an ink supply tube, according to another embodiment of the present invention.

Referring to FIG. 7, in another embodiment of the present invention, the distal end surface of an ink supply tube 40A may have an inclined surface, which may form an angle other than 90° with respect to the axial direction of tube 40 A.

Figure 8:
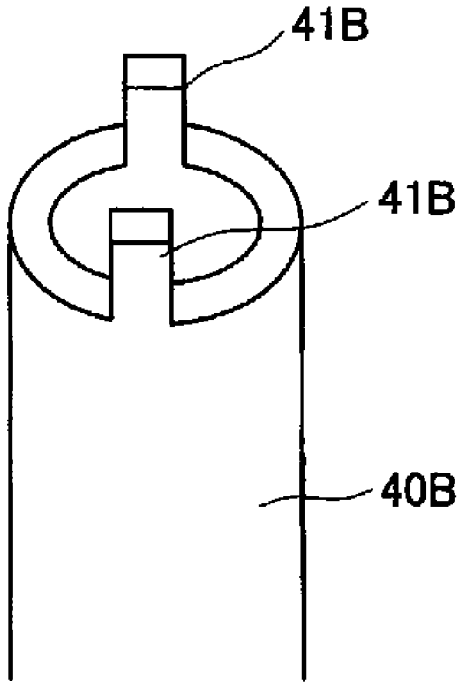
FIG. 8 is a perspective view of a distal end of an ink supply tube, according to yet another embodiment of the present invention.
Figure 9:
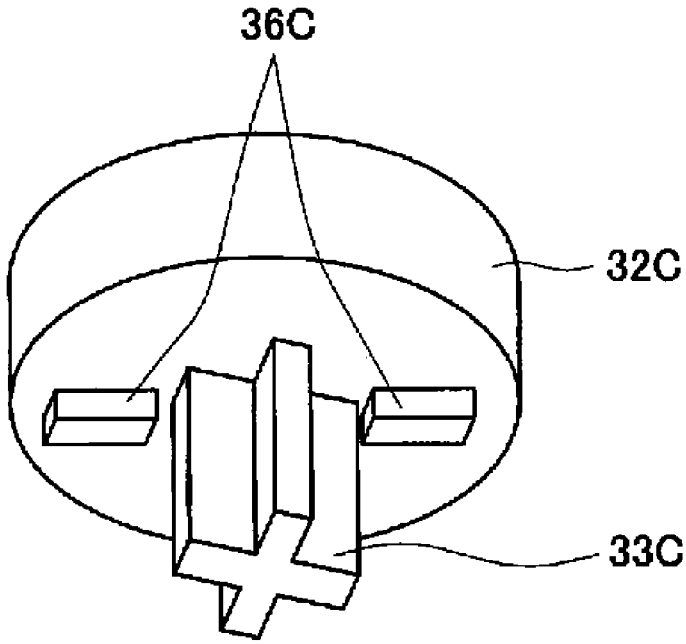
FIG. 9 is a perspective view of a valve member, according to another embodiment of the present invention.

Referring to FIG. 8, in yet another embodiment of the present invention, a protrusion 41B which projects in the axial direction of an ink supply tube 40B from the distal end surface thereof may be formed. Although not shown in the drawing specifically, the distal end surface of an ink supply tube may be entirely convex or concave. In these cases, when the distal end of the ink supply tube contacts the flat lower surface (pressed portion) of the valve body, a gap may be formed between the ink supply tube and the valve body. Therefore, ink may flow into the ink supply tube via the gap.

Figure 10:
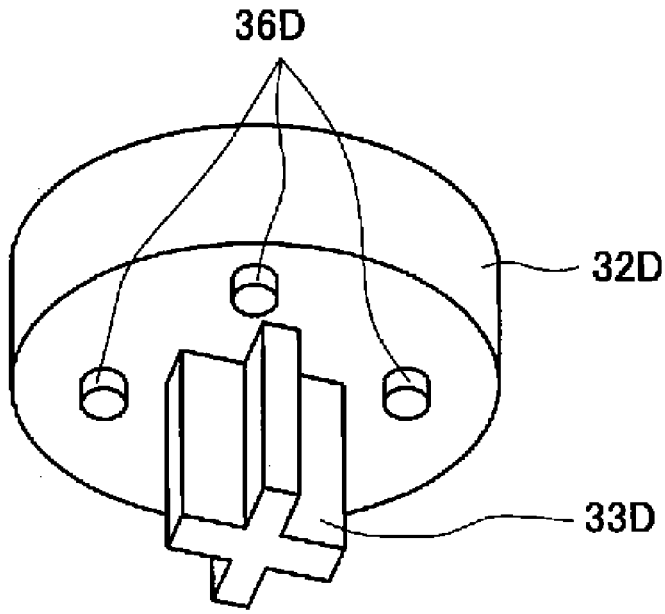
FIG. 10 is a perspective view of a valve member, according to yet another embodiment of the present invention.

In still another embodiment of the present invention, a protrusion may be formed on the lower surface of the valve body of the valve member of the cartridge, and the protrusion may protrude from the lower surface less further than the projecting portion protrudes, such that the protrusion may be pressed upward by the ink supply tube as the pressed portion. For example, referring to FIG. 9, a pair of parallelepiped protrusions 36C may be formed on the lower surface of a valve body 32C at positions in point symmetrical with respect to a center axis of a projecting portion 33C. Protrusions 36C protrude from the lower surface less further than projecting portion 33C protrudes. Referring to FIG. 10, in still yet another embodiment of the present invention, a plurality of column shaped protrusions 36D may be formed at regular intervals circumferentially around projecting portion 33D on the lower surface of valve body 32D. In these cases, when the ink supply tube contacts protrusions 36C or 36D as the pressed portions, a gap may be formed between the lower surface of the valve body and the distal end surface of the ink supply tube, whereby ink may flow into the interior of the ink supply tube via the gap. The protrusion as the pressed portion is not limited to the parallelepiped shape or the column shape, and those in various shapes may be employed. The number of the protrusions also may be varied, and the plurality of protrusions may be arranged respectively at regular intervals circumferentially around the projecting portion. In this case, the distal end of the ink supply tube may contact the plurality of protrusions, such that the valve member may be pressed stably, and the mounting of the ink cartridge may be performed more reliably.

Figure 11:
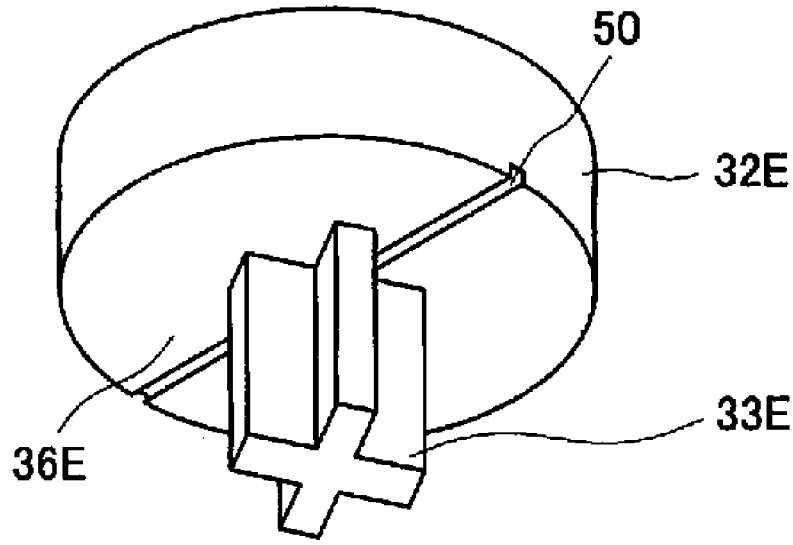
FIG. 11 is a perspective view of a valve member, according to still yet another embodiment of the present invention.
Figure 12:
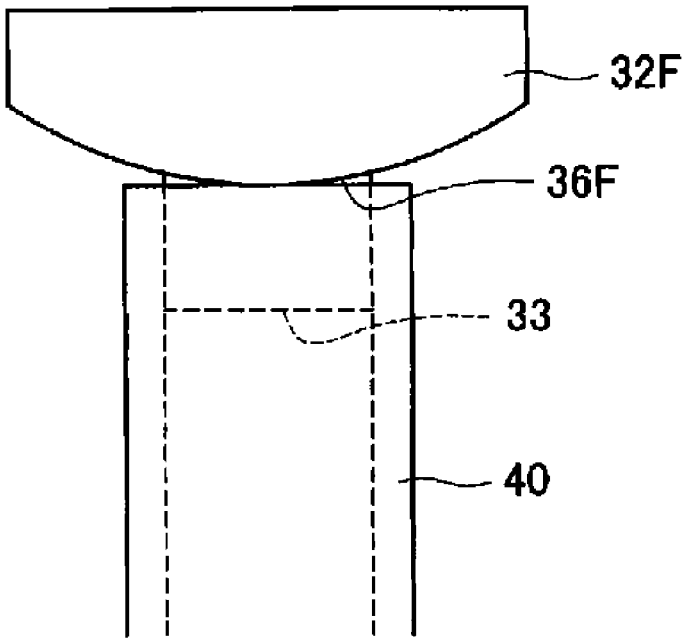
FIG. 12 is a diagram of an ink supply tube contacting a valve member, according to an embodiment of the present invention.
Figure 13:
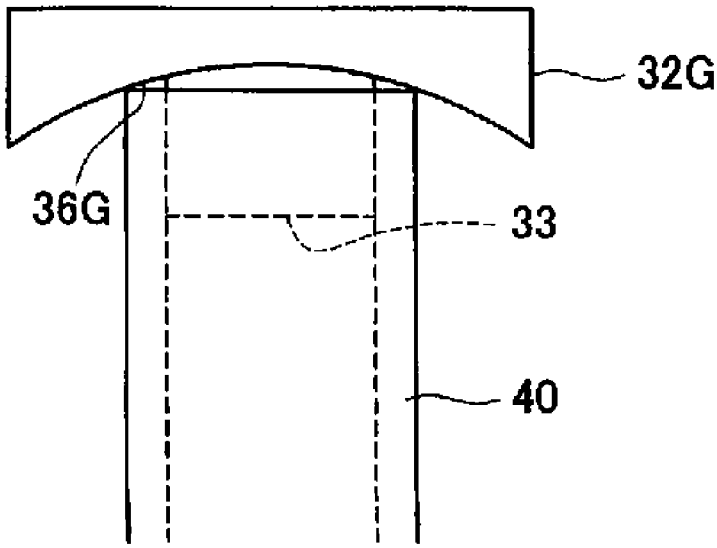
FIG. 13 is a diagram of an ink supply tube contacting a valve member, according to another embodiment of the present invention.
Figure 14:
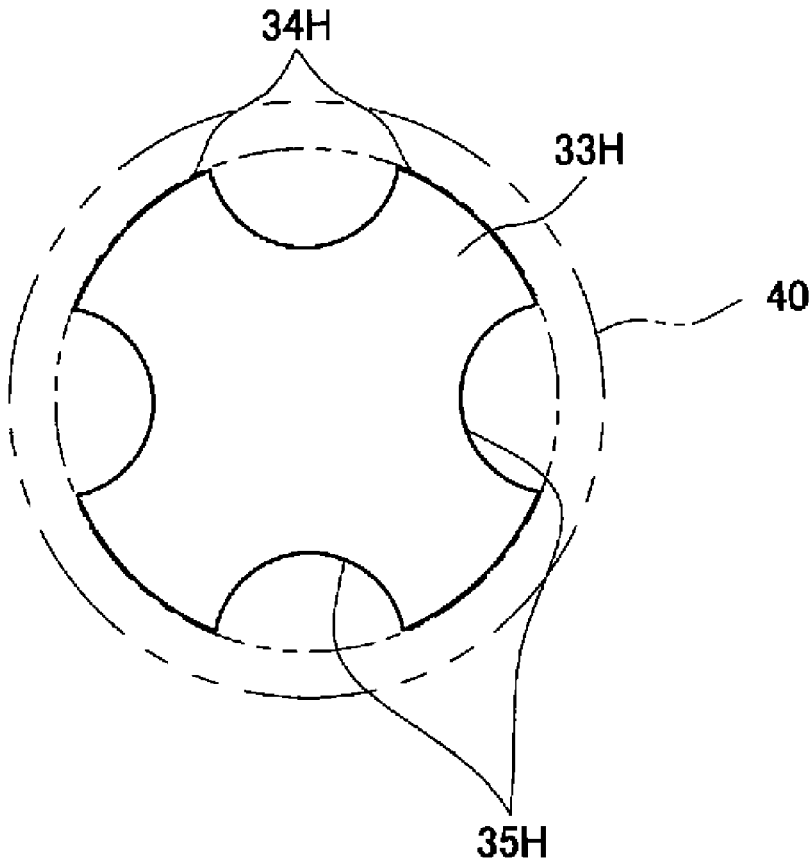
FIG. 14 is a diagram of a projecting portion of a valve member entering the interior of an ink supply tube, according to another embodiment of the present invention.
Figure 15:
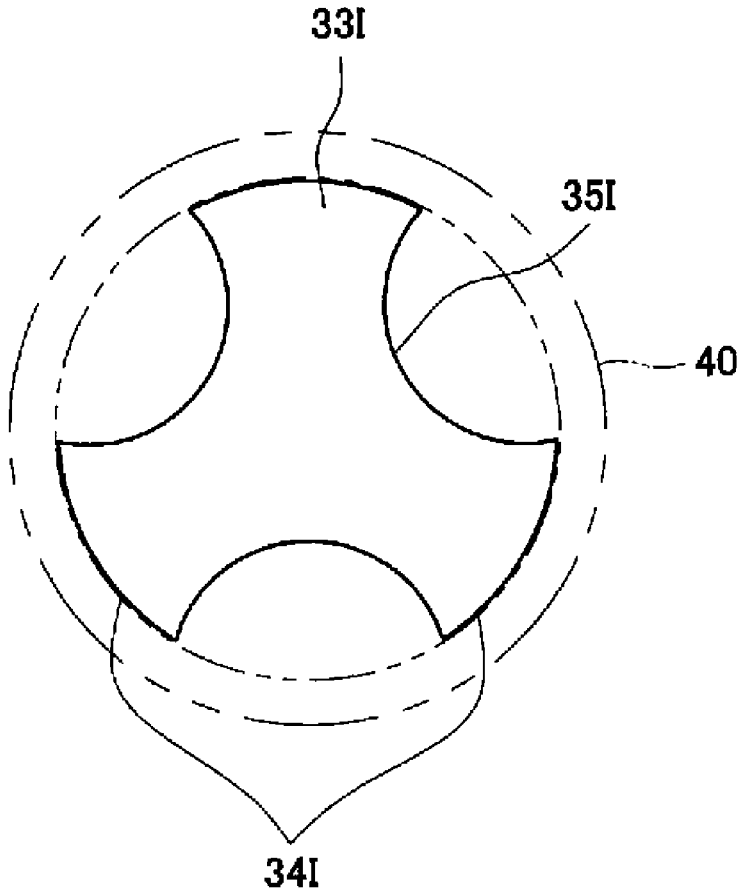
FIG. 15 is a diagram of a projecting portion of a valve member entering the interior of an ink supply tube, according to yet another embodiment of the present invention.

Referring to FIG. 11, in a further embodiment of the present invention, at least one groove 50 may be formed in a pressed portion 36E on the lower surface of a valve body 32E. Groove 50 may extend from a position adjacent to the center of a projecting portion 33E to the peripheral surface of valve body 32E. The number of the grooves 50 employed may be any number of grooves. In this case, when the ink supply tube contacts pressed portion 36E of valve body 32E, ink may flow into the interior of the ink supply tube via groove 50.

According to still a further embodiment of the present invention, the surface of the pressed portion of the valve body to be pressed by the ink supply tube may have a curved shape. For example, referring to FIGS. 12 and 13, the surface of a pressed portion 36F of a valve body 32F may be convex, or the surface of a pressed portion 36G of a valve body 32G may be concave. In these cases, when the ink supply tube contacts the pressed portion of the valve body, a gap may be formed between the valve body and the distal end surface of the ink supply tube, whereby ink may flow into the interior of the ink supply tube via the gap.

Figure 16:
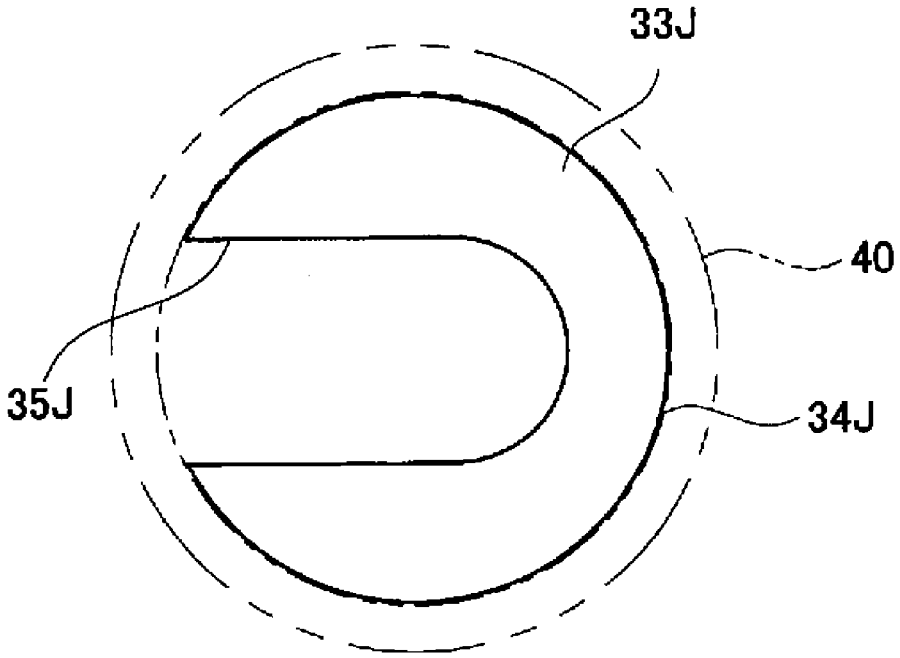
FIG. 16 is a diagram of a projecting portion of a valve member entering the interior of an ink supply tube, according to still another embodiment of the present invention.

Various shapes of projecting portion(s) may be employed instead of the cross-shape shown in FIGS. 3 and 4, so long as the projecting portion(s) contacts the inner surface of the ink supply tube and the passage is securely provided between the projecting portion and ink supply tube when the projecting portion enters the interior of the ink supply tube. For example, referring to FIG. 14, in another embodiment of the present invention, a plurality of non-contacting portions 35H, e.g., four non-contacting portions, arranged respectively between the adjacent ones of contacting portions 34H circumferentially of a projecting portion 33H each may be formed into a rounded recess when viewed in the direction that projecting portion 33H projects. Contacting portions 34 H may be configured to contact the interior of ink supply tube 40 and non-contacting portions 35H may not. The number of the contacting portions and the non-contacting portions arranged respectively between the adjacent contacting portions may be any number. For example, referring to FIG. 15, according to yet another embodiment of the present invention, three contacting portions 34I and three non-contacting portions 35I may be provided on a projecting portion 331. Referring to FIG. 16, according to still another embodiment of the present invention, a non-contacting portion 35J may be formed by removing a projecting portion 33J from the periphery surface to the axial center portion of projecting portion 33J. The remaining portion on the peripheral surface of the projecting portion 33J may serve as a contacting portion 34J configured to contact the interior of ink supply tube 40.

Figure 17:
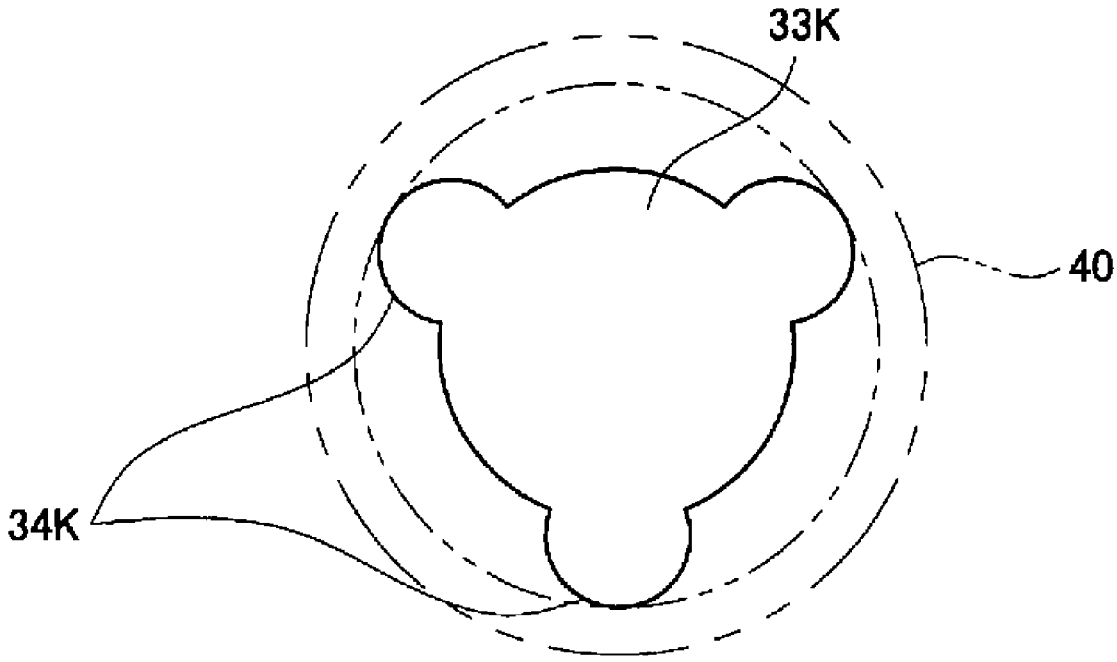
FIG. 17 is a diagram of a projecting portion of a valve member entering the interior of an ink supply tube, according to still yet another embodiment of the present invention.

Referring to FIG. 17, according to still yet other embodiments of the present invention, contacting portions 34K configured to contact the interior of ink supply tube 40 may have an arc shape when viewed in the direction that a projecting portion 33K projects. In addition, referring to FIGS. 18-21, projecting portions 33L, 33M, 33N, 33O may be formed by partly removing the peripheral surface of a column when viewed in the direction that projections project, such that the removed portions may serve as non-contacting portions 35L, 35M, 35N, and 35O, and the remaining portions may serve as contacting portions 34L, 34M, 34N, and 34O.

Figure 18:
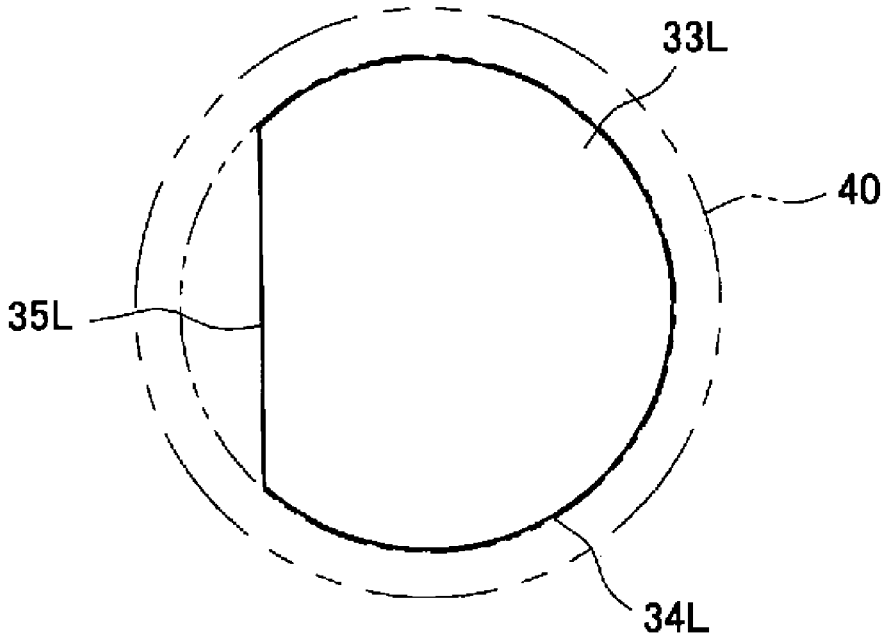
FIG. 18 is a diagram of a projecting portion of a valve member entering the interior of an ink supply tube, according to a further embodiment of the present invention.
Figure 19:
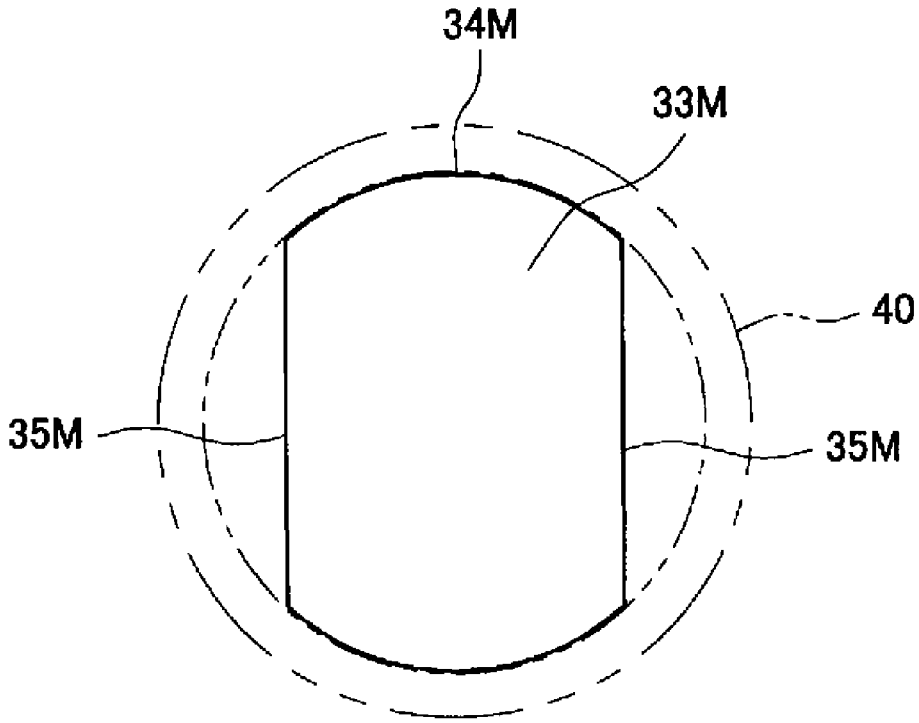
FIG. 19 is a diagram of a projecting portion of a valve member entering the interior of an ink supply tube, according to yet a further embodiment of the present invention.
Figure 20:
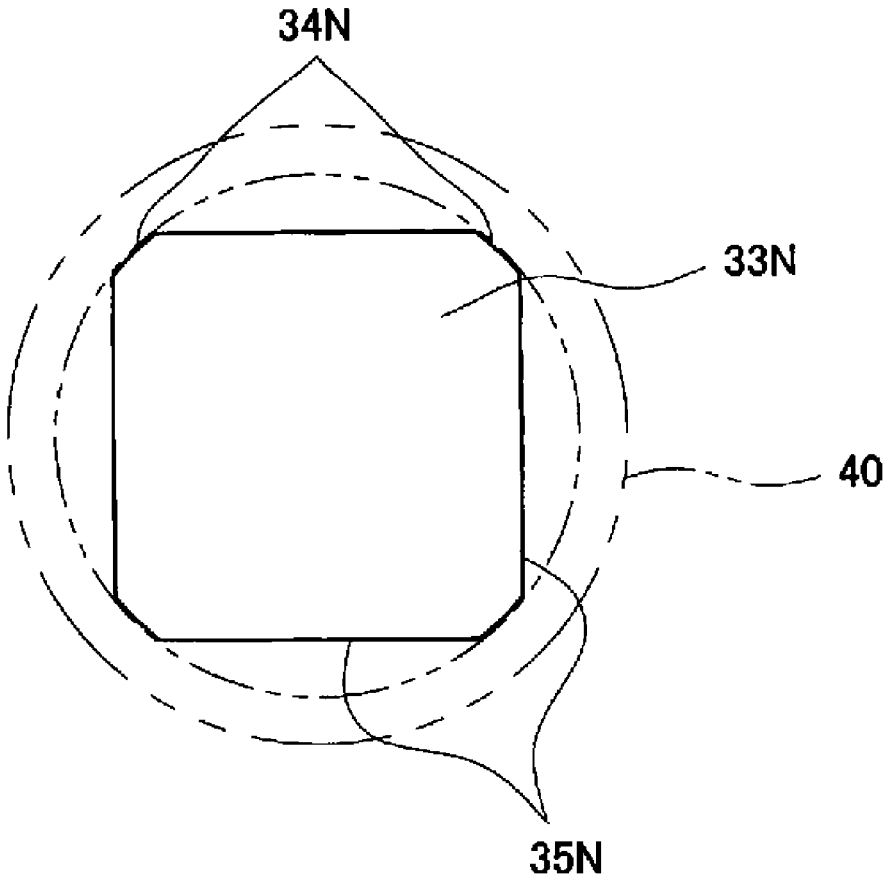
FIG. 20 is a diagram of a projecting portion of a valve member entering the interior of an ink supply tube, according to still a further embodiment of the present invention.
Figure 21:
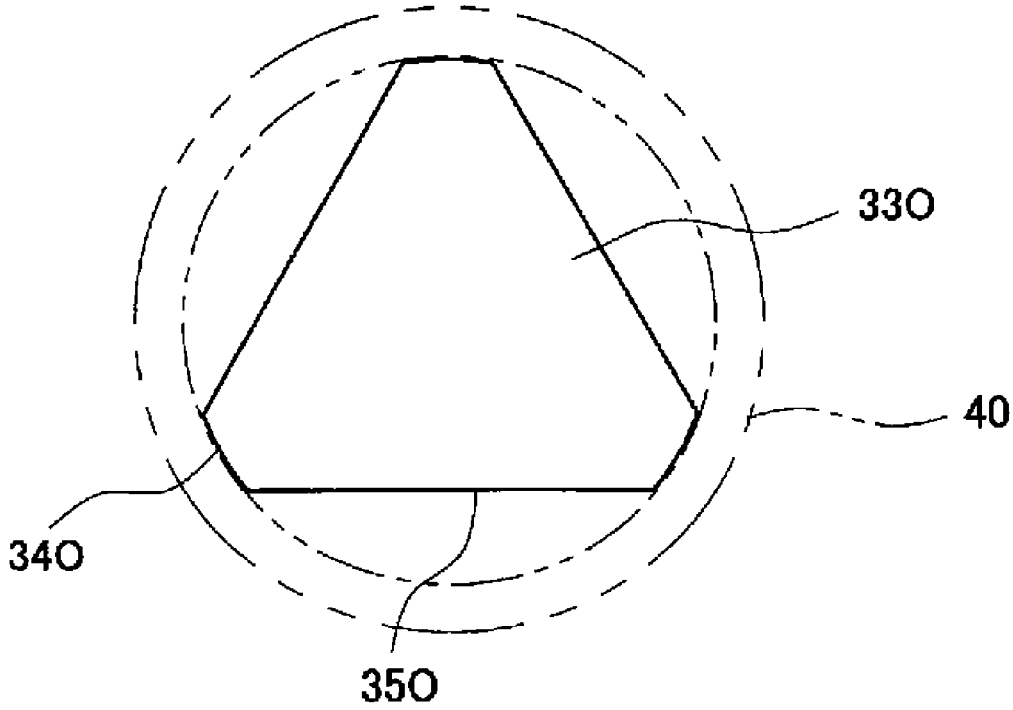
FIG. 21 is a diagram of a projecting portion of a valve member entering the interior of an ink supply tube, according to still yet a further embodiment of the present invention.

In order to provide reliable mounting of the ink cartridge by stabilizing the entering motion of the projecting portion, the plurality of contacting portions may be provided respectively at regular intervals in a circumferential direction of the projecting portion as shown in FIGS. 4, 14, 15, 17, and 19-21. Alternatively, the area of the contacting portions may be greater than the area of the non-contacting portions, as shown in FIGS. 16 and 18.

Figure 22:
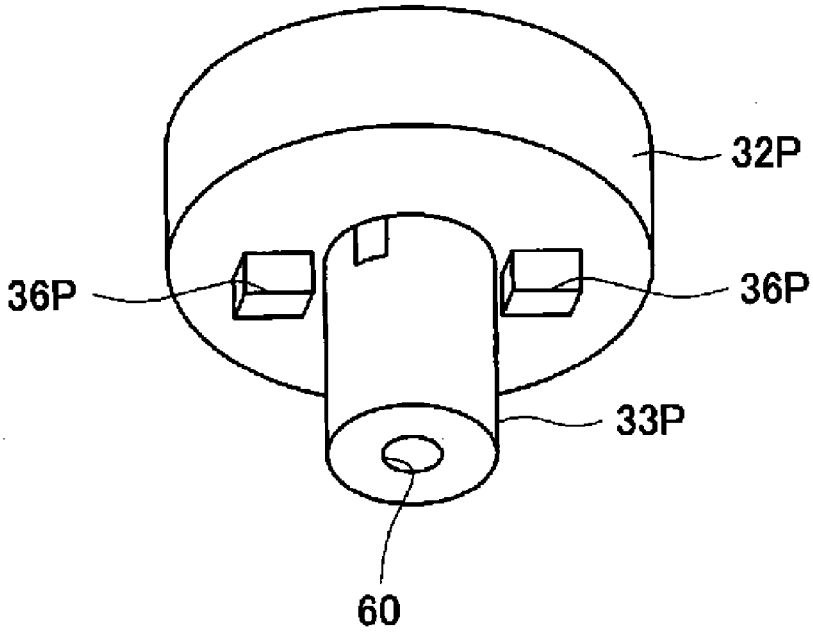
FIG. 22 is a perspective view of a valve member, according to still another embodiment of the present invention.
Figure 23:
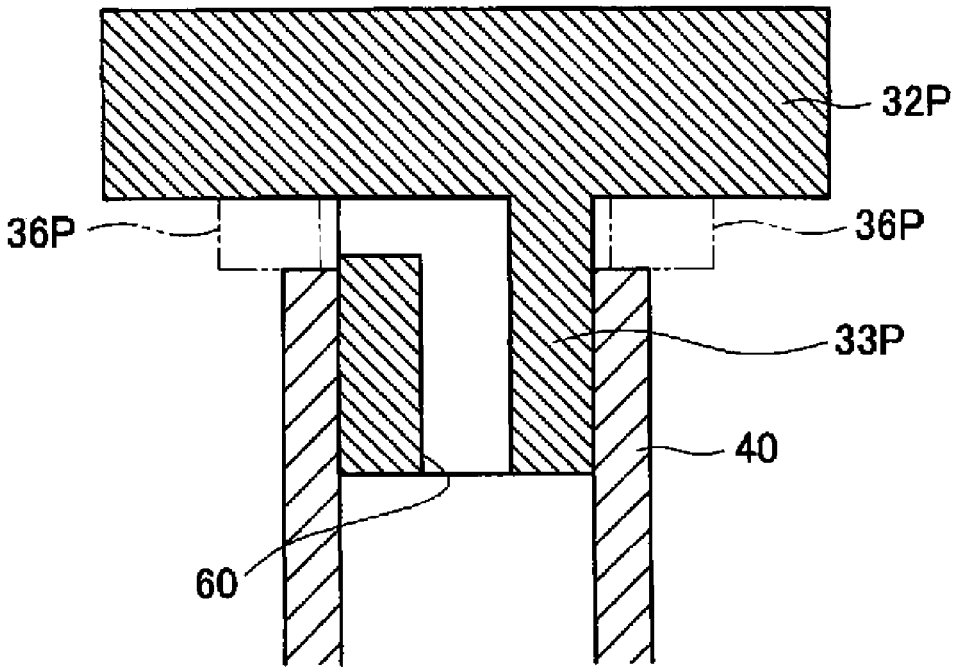
FIG. 23 is a cross-sectional view of a valve member in a state in which a projecting portion enters the interior of an ink supply tube, according to still yet another embodiment of the present invention.

Referring to FIGS. 22 and 23, protrusions 36P as the pressed portions may be provided on the lower surface of a valve body 32P at positions around a projecting portion 33P, and a through hole 60 may be formed through projecting portion 33P. According to a further embodiment of the present invention, through hole 60 may extend from the distal end of projecting portion 33P through the interior of projecting portion 33P and reach the peripheral surface of projecting portion 339 at the boundary between projecting portion 33P and the lower surface of valve body 32P. In this case, a passage from the ink cartridge to the interior of ink supply tube 40 may be provided by a gap formed between the lower surface of valve body 32P and ink supply tube 40 and through hole 60 formed within projecting portion 33P. In this embodiment of the present invention, non-contacting portions may not be included. Therefore, in order to stabilize the entering motion of projecting portion 33P, the projecting portion 33P may be formed into a column shape that contacts the inner surface of ink supply tube 40 over the entire peripheral surface thereof.

Referring to FIGS. 2, 5, and 6, valve member 44 may comprise a valve rod 45 positioned within ink supply tube 40, such that when valve rod 45 is pressed downward by projecting portion 33 of valve member 31, valve member 44 may allow communication therebetween. Nevertheless, valve rod 45 may be omitted, and valve member 44 of holder 11 may be directly pressed by projecting portion 33 of valve member 31. In this case, because valve member 44 may be positioned within ink supply channel 42, valve member 44 may be prevented from being erroneously pressed when the ink cartridge is not mounted to the holder.

In the above-described embodiments of the present invention, the ink cartridge may be mounted and demounted in the vertical direction with respect to the holder. Nevertheless, the ink supply tube of the holder may extend in the horizontal direction and the ink cartridge may be mounted and demounted with respect to the holder in the horizontal direction.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. An ink cartridge comprising:

a cartridge body comprising:

an ink storage chamber configured to store ink therein; and a particular wall having an ink introduction hole formed therethrough, wherein the ink introduction hole is configured to receive an ink supply tube of an inkjet printer when the ink cartridge is mounted to the inkjet printer, and the ink supply tube is configured to communicate with an ink supply channel of the inkjet printer via a communication path;

a first valve member configured to selectively open and close the ink introduction hole; and a first urging member configured to apply a first force to the first valve member to urge the first valve member to close the ink introduction hole, wherein the first valve member comprises:

a valve body configured to receive a second force from the ink supply tube when the ink cartridge is mounted to the inkjet printer, wherein the second force urges the first valve member to open the ink introduction hole, and the second force is greater than the first force; and a projecting portion which projects from the valve body in a predetermined direction toward the exterior of the ink storage chamber via the ink introduction hole, wherein the projecting portion is configured to enter the ink supply tube and to apply a third force to a second valve element of the inkjet printer to urge the second valve element to open the communication path between the ink supply tube and the ink supply chamber when the ink cartridge is mounted to the inkjet printer, wherein a second urging member of the inkjet printer is configured to apply a fourth force to the second valve element to urge the second valve element to close the communication path between the ink supply tube and the ink supply chamber, and the third force is greater than the fourth force.

2. The ink cartridge of claim 1, wherein the projecting portion comprises:

a distal end; and a peripheral surface which connects the valve body to the distal end.

3. The ink cartridge of claim 2, wherein the peripheral surface comprises at least one contact portion configured to contact an inner surface of the ink supply tube and at least one non-contact portion configured not to contact the inner surface of the ink supply tube when the projecting portion enters the ink supply tube.

4. The ink cartridge of claim 3, wherein:

the at least one contact portion comprises a plurality of contact portions positioned at regular intervals circumferentially; and the at least one non-contact portion comprises a plurality of non-contact portions, wherein each of the plurality of non-contact portions are positioned between adjacent ones of the plurality of contact portions in a circumferential direction.

5. The ink cartridge of claim 2, wherein the projecting portion has a hole formed therethrough, and the hole extends from the distal end through the interior of the projecting portion and reaches the peripheral surface at a boundary between the valve body and the projecting portion.

6. The ink cartridge of claim 3, wherein an area of each of the at least one contact portions is greater than an area of each of the at least one non-contact portions.

7. The ink cartridge of claim 1, wherein the valve body comprises:

a plane orthogonal to the predetermined direction; and a peripheral surface extending from an edge of the plane, wherein a groove is formed in the plane and the groove extends to the peripheral surface of the valve body.

8. The ink cartridge of claim 1, wherein the valve body comprises a pressed portion, and the pressed portion comprises at least one protrusion projecting from the valve body in the predetermined direction, wherein the projecting portion extends from the valve body further than the at least one protrusion projects from the valve body.

9. The ink cartridge of claim 8, wherein the at least one protrusion comprises a plurality of protrusions, wherein the plurality of the protrusions are positioned around the projecting portion at regular intervals circumferentially, and the projecting portion extends from the valve body further than each of the plurality of protrusions project from the valve body.

10. The ink cartridge according to claim 8, wherein a surface of the pressed portion comprises a curved surface.

11. The ink cartridge of claim 1, wherein the particular wall comprises a resilient member.

12. An inkjet printer comprising:

an ink supply tube configured to enter an ink introduction hole of an ink cartridge and to apply a first force to a valve body of a first valve member of the ink cartridge when the ink cartridge is mounted to the inkjet printer, wherein a first urging member of the ink cartridge is configured to apply a second force to the first valve member to urge the first valve member to close the ink introduction hole, wherein the first force is greater than the second force;

an ink supply channel configured to communicate with the ink supply tube via a communication path;

a second valve member configured to selectively open and close the communication path between the ink supply tube and the ink supply channel; and a second urging member configured to apply a third force to the second valve member to urge the second valve member to close the communication path between the ink supply tube and the ink supply channel, wherein a projection portion of the valve body of the first valve member is configured to apply a fourth force to the second valve member to urge the second valve member to open the communication path between the ink supply tube and the ink supply channel when the ink cartridge is mounted to the inkjet printer, and the fourth force is greater than the third force.

13. The inkjet printer of claim 12, wherein the second valve member is positioned within the ink supply tube and does not project outward from the ink supply tube.

14. The inkjet printer of claim 12, wherein the second valve member is positioned within the ink supply channel and does not projected outward from the ink supply tube.

15. An inkjet printing apparatus, comprising:

an inkjet printer comprising:

an ink supply tube;

an ink supply channel configured to communicate with the ink supply tube via a communication path;

a first valve member configured to selectively open and close the communication path between the ink supply tube and the ink supply channel; and a first urging member configured to apply a first force to the first valve member to urge the first valve member to close the communication path between the ink supply tube and the ink supply channel; and an ink cartridge comprising:

a cartridge body comprising:

an ink storage chamber configured to store ink therein; and a particular wall, wherein the particular wall has an ink introduction hole formed therethrough;

a second valve member configured to selectively open and close the ink introduction hole; and a second urging member configured to apply a second force to the second valve member to urge the second valve member to close the ink introduction hole, wherein the second valve member comprises:

a valve body; and a projecting portion which projects from the valve body in a predetermined direction toward the exterior of the ink storage chamber via the ink introduction hole, wherein the ink cartridge is configured to be mounted to the inkjet printer, and the ink introduction hole is configured to receive the ink supply tube when the ink cartridge is mounted to the inkjet printer, wherein the projecting portion is configured to enter the ink supply tube and to apply a third force to the first valve member to urge the first valve member to open the communication path between the ink supply tube and the ink supply channel when the ink cartridge is mounted to the inkjet printer, and the ink supply tube is configured to apply a fourth force to the valve body of the second valve member to urge the second valve member to open the ink introduction hole when the ink cartridge is mounted to the inkjet printer, wherein the third force is greater than the first force, and the fourth force is greater than the second force.

* * * * *